US005643684A

United States Patent [19]

Tsubouchi et al.

[11] Patent Number: 5,643,684

[45] Date of Patent: Jul. 1, 1997

[54] UNWOVEN METAL FABRIC

[75] Inventors: Toshiyasu Tsubouchi; Satoru Okamoto; Tomohiko Ihara, all of Itami, Japan

[73] Assignee: Sumitomo Electric Industries, Ltd., Osaka, Japan

[21] Appl. No.: 459,771

[22] Filed: Jun. 2, 1995

[30] Foreign Application Priority Data

Jun. 9, 1994 [JP] Japan ..... 6-127508
May 11, 1995 [JP] Japan ..... 7-113259

[51] Int. Cl.[6] ..... B23P 17/06

[52] U.S. Cl. ..... 428/605; 428/606; 428/608; 428/613; 428/687; 428/397; 428/400; 428/401; 428/398; 442/338; 442/377

[58] Field of Search ..... 428/288, 605, 428/606, 608, 613, 687, 397, 400, 401, 398; 429/208

[56] References Cited

U.S. PATENT DOCUMENTS 4,999,240 3/1991 Brotz .
5,434,023 7/1995 Teraoka et al. ..... 429/218

FOREIGN PATENT DOCUMENTS 0 932 082 10/1990 European Pat. Off. .
0 404 961 1/1991 European Pat. Off. .

*Primary Examiner*—Kathleen Choi
*Attorney, Agent, or Firm*—Wenderoth, Lind & Ponack

[57] ABSTRACT

An unwoven metal fabric suitable for use as a battery electrode, a catalyst or a filter, and a method of manufacturing such fabric. An unwoven carbon fabric made up of carbon fibers bound together by a resin is heated to carbonize the binder resin and thus to impart electrical conductivity to the resin, and at the same time finely roughen the surfaces of the carbon fibers and the resin. A plating layer is directly formed on the unwoven carbon fabric thus formed by electroplating. Then, the unwoven carbon fabric is removed by roasting to provide an aggregate of metal fibers joined together and having their voids communicating with one another.

5 Claims, 2 Drawing Sheets

UNWOVEN METAL FABRIC

BACKGROUND OF THE INVENTION (1) Field of the Invention

This invention relates to an unwoven metal fabric which is a kind of porous metal structure for various uses such as battery electrodes, catalysts and filters and a method of manufacturing the same.

(2) Description of the Prior Art

Conventional battery electrodes and filters are formed from ultra-fine metal fibers entangled together. Different materials and various new techniques for forming them have been developed.

For example, Unexamined Japanese Patent Publication 4-11058 discloses a material made of metal fibers that are joined together so that the length of the joint portions will be more than 0.7 time the average fiber diameter, and a method of manufacturing the same. Unexamined Japanese Patent Publication 3-17957 proposes a material made of metal fibers which are subjected to pre-plating treatment using precious metal catalysts to improve the adhesion of plating to the fibers, and a method of manufacturing the same.

Also, Unexamined Japanese Patent Publication 61-76686 proposes to provide a metal coating on a felt member by sputtering under vacuum in order to provide an electrode having a high porosity. But the methods disclosed in these publications require complicated processes such as preplating treatment by catalysts and sputtering, so that mass-productivity is low. Also, if the electrodes thus formed contain more than 100 ppm metallic impurities resulting from the catalysts used, their properties will vary so widely that they will not stand practical use.

In order to solve these problems, Unexamined Japanese Patent Publication 4-126859 proposes a metal fiber material formed by electroplating a high-conductivity carbon fiber sheet and removing the substrate. The carbon fiber sheet used here is manufactured by forming a mixture of carbon fibers and a substance for bonding fibers (hereinafter referred to as "binder") into sheet form and drying it.

The carbon fibers in such a carbon fiber sheet have a resistivity of mere $10^{-3}$–$10^{-4}\Omega\cdot$cm. But the binder surrounding the carbon fibers has a very high resistivity because it is an insulating material. It is not an easy job to directly electroplate such a sheet. It would be possible to reduce the content of the binder in order to increase the conductivity of the entire sheet. But this will make it necessary to increase the amount of plating to make up for the reduced adhesion between fibers. The metal fiber product thus obtained would have a porosity of 80–90%, which is too low for use as battery electrodes.

It is possible to reduce the resistivity of the fiber material by increasing its firing temperature to 1000° C. or higher to graphitize the fiber. But since the fibers are joined together by the resin binder, it is impossible to electroplate such joint portions. The metallic porous member thus formed tends to be low in mechanical strength and unsatisfactory in its electrical properties. Also, excessive graphitization would make it necessary to increase the temperature to 900° C. or higher in removing the substrate by thermal oxidation in the later step. This will in turn result in reduced strength of the unwoven fabric formed.

One solution to these problems is to increase the thickness of plating to 500–1000 g/m$^2$ because such a thick plating layer provided on the carbon fiber portions overhangs the binder portions. But it is not easy to provide a thick plating having a uniform thickness over the entire area. Also, such a thick plating layer tends to keep a web form because it is difficult to roll. This solution is therefore not suitable for continuous production. Thus, it is an ordinary practice to increase the conductivity of the material by electroless plating and then provide an electroplating layer of a predetermined thickness.

The unwoven fabric formed by this conventional method shows high mechanical strength because plating is provided between fibers. But due to the properties of the plating solution, variations in the distribution of fibers tend to widen. The unwoven fabric thus formed is low in quality stability. If this unwoven fabric is used for batteries, the content of metallic impurities which have been used as catalysts will exceed 100 ppm, so that the variations in the properties of electrodes will increase to such a extent that such electrodes are practically useless. It is therefore desired to provide a method for manufacturing a stable metallic unwoven fabric without reducing the number of joint portions between metal fibers.

OBJECTS OF THE INVENTION

An object of the present invention is to provide a method of manufacturing an unwoven metal fabric in which by making possible a direct, stable electroplating of unwoven carbon fiber, the amount of impurities is reduced and the variation in quality is minimized while keeping the mechanical strength and the porosity at high level.

Another object of the prevent invention is to provide an unwoven metal fabric which is uniform in quality and low in the content of impurities, has high mechanical strength and porosity and a large surface area of the metal portion, and is highly resistant to thermal stress.

SUMMARY OF THE INVENTION

According to this invention, unwoven carbon fabric having carbon fibers bound together by a resin is heated preferably at a temperature of 550°–850° C. in an inert atmosphere using $N_2$ gas or Ar gas for one to two hours to impart conductivity to the binder resin by carbonizing it. During this carbonizing process, the fiber surfaces and the resin surface at its joint portion are finely roughened. A metal layer is formed on the surface of the substrate of the unwoven carbon fabric thus heat-treated (i.e. on the surfaces of the fibers and the resin) by electroplating. Then, the unwoven carbon fabric is removed by roasting (baking for decarbonization), leaving an aggregate of hollow metal fibers connected together and having their voids communicating with each other. The aggregate of hollow metal fibers thus formed is heated in a reducing atmosphere to densify them. The desired unwoven metal fiber, is thus obtained.

DETAILED DESCRIPTION OF THE INVENTION

The unwoven carbon fiber, which is the substrate of the metal fabric according to this invention, is prepared by forming a mixture of carbon fibers and a binder into sheet form and drying the sheet thus formed so as to have a desired porosity. The carbon fibers used may be mainly carbon fibers, graphite fibers or activated carbon fibers.

The carbon fiber should be obtained by baking at preferably 750°–900° C. If less than 750° C., the resistivity of the carbon fibers will become too high ($10^4$–$10^6\Omega\cdot$cm), so that the resistivity of the sheet will be too high for the sheet to be electroplated. If higher than 900° C., the fabric has to be heated in baking after electroplating to more than 750° C. to remove carbon fibers and binder. This lowers the strength of the unwoven metal fabric.

The diameter of the fibers should be 7–20 μm. If less than 7 μm, the fabric formed into sheet will be too limp and thus difficult to handle. If over 20 μm, the sheet formed will be too stiff. The carbon packing density (how much fiber is filled per unit volume) when the carbon fibers are formed into sheet form is determined by the fiber length. The packing density in turn determines the structure of the unwoven metal fabric finally obtained.

Namely, if the fabric formed is used as a filter, the carbon packing density factor will influence its collecting capacity. If it is used as a battery electrode, the carbon packing density will influence the contents of active materials. Also, it influences the strength of the sheet. The fiber length should be determined so that the fiber packing density will be 2–20%. If the fiber length is longer than 20 mm, the packing density will be less than 2%. The sheet formed tends to be too low in strength. If the fiber length is shorter than 3 mm, the fiber packing density will exceed 20%. The fabric formed tends to be too low in porosity.

The amount of resin relative to the amount of carbon fibers should be within a predetermined range. If lower than this range, it will be impossible to form the fibers into sheet form. If higher than the range, the fabric will be clogged with the resin. The amount of resin is adjustable by removing the volatile content by heating it. The structure of the end product is influenced by the amount of resin.

To remove the volatile content of the resin, the fabric should be heated at a temperature between 200° C. and 350° C. in the atmosphere. At a temperature less than 200° C., the volatile content would not volatilize sufficiently. The resin may foam when the fiber sheet is later subjected to carbonizing later. If higher than 350° C., the resin would decompose, weakening the structure of the fabric in sheet form. The heating conditions should be controlled so that after this step, the resin content decreases to 5–15 wt %. If less than 5 wt %, it would be difficult for the fabric to retain its sheet form. If more than 15 wt %, the fabric may be clogged with resin and also tend to be stiff and difficult to bend. This step should be carried out for 10–90 minutes in the atmosphere.

Then, the resin is carbonized in a non-oxidizing atmosphere. The non-oxidizing gas used here may be $H_2$, low-molecular hydrocarbon, argon, $N_2$ gas. Argon or $N_2$ gas is preferable. The heat treatment for carbonizing should be carried out once or more than once at 500°–850° C. From an economical viewpoint, the duration of this step should be limited within 90 minutes. If the temperature is less than 500° C., the resin will not carbonize sufficiently and thus the fabric will be low in conductivity for electroplating. If higher than 850° C., the resin will carbonize excessively, so that the fabric sheet will be low in flexibility. Under these conditions, the resin at the surface of carbon fibers and at the joint portions between carbon fibers tend to agglomerate upon carbonizing, so that the fabric thus treated will have a surface roughness of 0.5–1.5 μm. It is preferable to treat the fabric for about one hour at 550°–700° C.

The carbon unwoven fabric thus formed shows electrical conductivity even at the joint portions. Its surface roughness is 0.5–1.5 μm. It is flexible enough to withstand continuous plating. The surface roughness refers to irregularity in the direction of thickness of carbon fiber.

Plating treatment is carried out using the unwoven carbon fiber as a cathode. The metal to be plated may be of any kind provided it can be electroplated. Preferably, a metal should be selected from Ni, Cu, Ag and Fe. As plating baths for Ni, Cu, Ag and Fe, watts type, a copper sulfate solution, a silver cyanide solution, and a ferrous sulfate solution are ordinarily used, respectively.

Plating conditions will be described in detail in the description of Examples. They are determined so that the plating obtained has an average thickness of 3–10 μm. If thinner than 3 μm, the fabric tends to be too low in strength and too flexible to maintain its quality. If thicker than 10 μm, the entire unwoven fabric would become so stiff that it is more likely to develop cracks when bent and also its porosity would be low.

The porosity of the unwoven metal fabric should be controlled to 80–98% by adjusting the packing density and the resin content of the unwoven carbon fabric and the thickness of plating.

The metallic unwoven fabric after plating should be roasted in the atmosphere within the temperature range of 600°–900° C. according to the kind of metal used to remove the carbon fiber.

The unwoven fabric made up of metal fibers which has been surface-oxidized and hollowed by roasting is reduced in a reducing atmosphere at a temperature of 600°–1000° C. into an end product.

In the aggregate of hollow metal fibers thus obtained, all the fiber are hollow and each fiber has a roughness of 0.5–1.5 μm both on the inner and outer surfaces, with the hollow fibers intersecting each other. The joint portions between them are wide and joined together due to carbonization of the resin. Namely, the joint portions have at least a width equal to or more than 50% of the diameter of the hollow portion of each fiber (approximate to the original carbon fiber diameter). This prevent the metal at the joint portions from being extremely thick. Such wide joint portions are obtained by adjusting the resin content present in the unwoven carbon fabric to 5–15 wt % by heat treatment in the atmosphere.

According to the method of this invention, the resin binder forming the unwoven carbon fabric is given conductivity by carbonizing it. Thus, it is possible to form a metal layer directly on the surface of the resin, as well as on the carbon fibers, by electroplating. Thus, there is no need to subject the fabric to electroless plating, which is not favorable because it tends to widen quality variation of metal fabrics obtained and also it causes the inclusion of impurities.

Further, by electroplating, the plating layer is deposited uniformly on the unwoven carbon fabric, so that the wall thickness of the metal fibers will be very uniform. Thus, the wall thickness of the hollow metal fibers can be made extremely thin, while keeping a required mechanical strength of the fibers. This makes it possible to increase the porosity of the entire fabric by reducing the wall thickness of the plated layer.

The unwoven metal fabric formed by the method according to this invention is made up of metal fibers having their voids communicating with one another and having their inner and outer surfaces toughened finely. Thus, its surface area is extremely large, so that such metal fabric is especially suited for use as a catalyst or a catalyst carrier. Also, because of its large surface area and high porosity, it shows excellent collecting capacity when it is used as filter.

Moreover, because of its hollow structure and low metal-to-void ratio, the metal fabric according to the present invention is extremely lightweight. Also, since metal fibers are strongly bound together, the fabric as a whole has high mechanical strength. Due to uniform wall thickness of the metal fibers, local stress concentration is less liable to occur. This leads to prolonged life expectancy of the fabric.

Other features and objects of the present invention will become apparent from the following description made with reference to the accompanying drawings, in which:

THE PREFERRED EMBODIMENTS

EXAMPLE 1

Figure 1A:
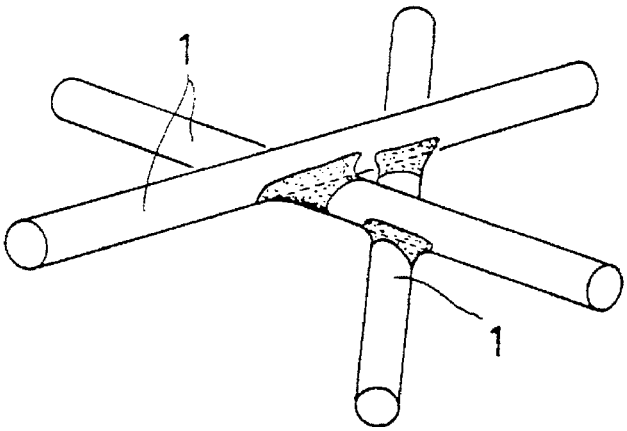
FIGS. 1A to 1C are partially cutaway enlarged perspective views of the unwoven metal fabric according to this invention, showing it after each of the manufacturing steps.
Figure 2A:
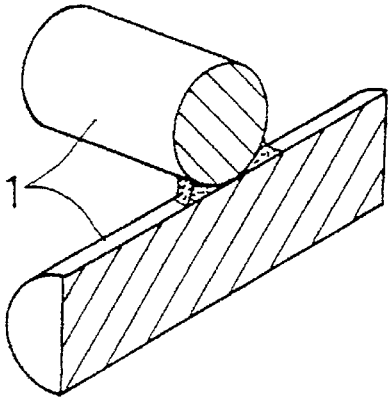
FIGS. 2A to 2C are enlarged perspective views of joint portion of the unwoven metal fabric, showing it after each of the manufacturing steps.

An unwoven fabric 0.3 mm thick and 40 g/m$^2$ in weight per unit area was formed from 13 μm-diameter carbon fibers 1, using an epoxy resin as a binder. The content of resin was 20 wt %. FIG. 1A shows an enlarged view of its part. FIG. 2A shows its joint portion.

Figure 1B:
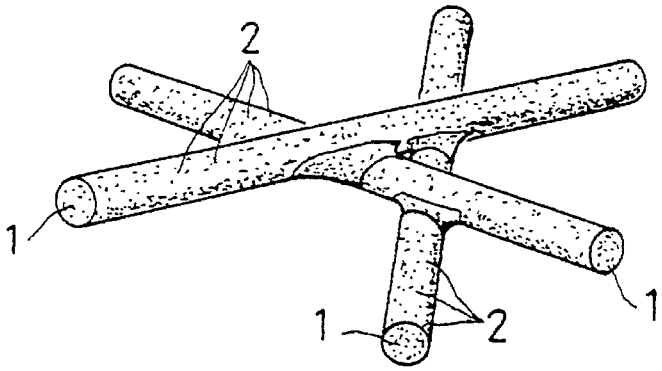
Figure 2B:
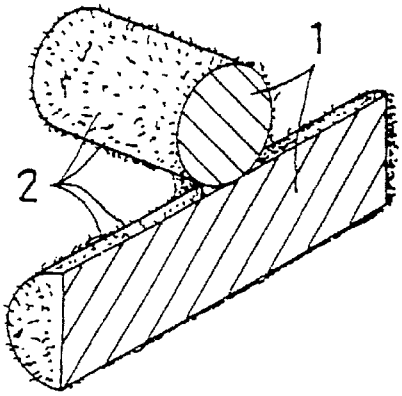

This unwoven fabric was heated at 300° C. in the atmosphere for one hour to remove any low-temperature-volatile content in the binder. As a result, the content of binder decreased to 10.1 wt % of the entire unwoven fabric. Then, the fabric was heated at 650° C. for one hour in $N_2$ gas. Fig. 1B shows its portion. The surface is seen to have irregularities 2. FIG. 2B shows its joint portion.

Figure 1C:
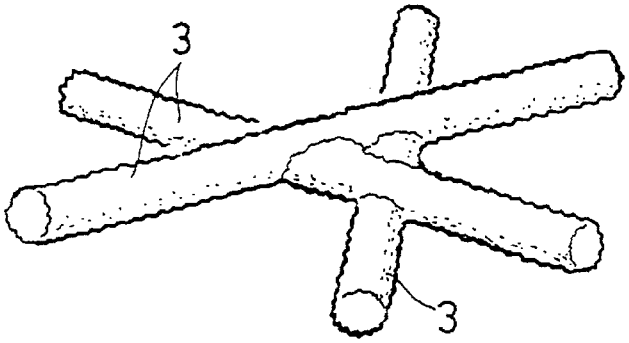

The fabric obtained was cut to a 200 mm×400 mm sheet. The sheet was immersed in a nickel plating bath shown in FIG. 1 and plated for 30 minutes while applying a current at a rate of 9.42 A/dm$^2$ to form a plating layer 3. FIG. 1C shows a portion of the fabric thus obtained.

Figure 2C:
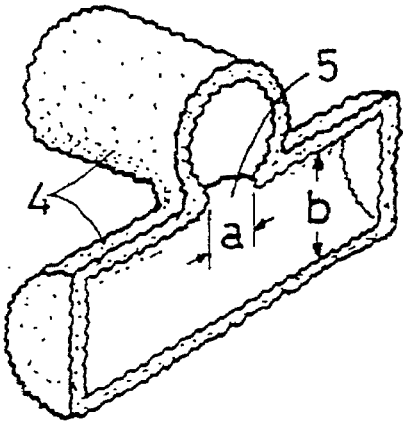

Part of the fabric thus obtained was cut off and observed under an optical microscope to measure the thickness of plating and the extent of surface irregularity was observed under a scanning microscope. The results of measurements are shown at No. 1 in Table 1. The gap width at the joint in the table is the value a in FIG. 2C and the gap diameter in the table is the value b in FIG. 2C. This is the case for the other tables.

EXAMPLE 2

Carbon fabrics were prepared in the same manner as in Example 1 with different contents of epoxy resin as shown at Nos. 2–7 of Table 1. They were heated under the same conditions as in Example 1, and then plated with nickel. Table 1 shows the results of observations of these specimens. The specimens had different plating thicknesses from one another. This was accomplished by changing the plating time.

EXAMPLE 3

An unwoven fabric 0.42 mm thick and 30 g/m$^2$ in weight per unit area was formed from carbon fibers 1 having a diameter of 7 μm, using an unsaturated polyester resin as a binder. The content of resin was 20 wt % of the entire fabric.

This unwoven fabric was heated at 280° C. in the atmosphere for 40 minutes to remove any low-temperature-volatile content in the binder until the content of binder decreases to 9.0 wt %. Then, the fabric was heated at 750° C. for 40 minutes in $N_2$ gas.

The material thus obtained was wound on a 200-mm-diameter roll, and passed through a plating bath for 25 minutes while applying a current at a rate of 11.3 A/dm$^2$ to form a nickel plating layer 3 shown in FIG. 1C by continuous plating.

The fabric thus obtained was then roasted at 900° C. for 10 minutes, and heated at 1000° C. in $H_2$ gas to reduce its surface. An unwoven fabric made up of hollow metal fibers 3 shown in FIG. 2C was obtained. As is apparent from this figure, the interior of one metal fiber 3 communicates with that of another through an opening 5 at the joint portion. The diameter a of the opening 5 (gap width at joint) and the internal diameter b of the metal fibers 3 (gap diameter) are determined to satisfy the relation a/b>0.5.

Part of the metallic unwoven fabric thus obtained was cut off for observation under an optical microscope and to measure its tensile strength. The results of observation and measurement are shown at No. 8 in Table 2.

EXAMPLE 4

The same carbon fabrics as used in Example 3 were heated under different heating conditions shown in Table 2 at Nos. 9–20. They were then plated with nickel in the same manner as in Example 3. There were some specimens which could not be wound on rolls. Such specimens were cut to 200 mm×400 mm sheets and plated in batches. These speciments were plated for 25 minutes while applying a current at a rate of 11.3 A/dm$^2$. The results are shown at Nos. 9–20 in Table 2.

EXAMPLE 5

The same unwoven carbon fabric as used in Example 1 was heated in the same manner as in Example 1.

The unplated unwoven fabric thus obtained was cut to 200 mm×400 mm sheets, and the sheets were plated with nickel in the nickel bath shown in Table 1 under different plating conditions.

After plating, the sheets were roasted and reduced under the conditions shown in Table 3.

Part of each sheet was cut off for optical microscopic observation and to measure its tensile strength. The results of observation and measurement are shown at Nos. 21–27 in Table 3.

EXAMPLE 6

The same unwoven carbon fabric as used in Example 1 was heated in the same manner as in Example 1.

The unplated unwoven fabric thus obtained was cut to a 200 mm×400 mm sheet, and the sheet was plated with Cu in a bath (containing 200 g/l of $CuSO_4 \cdot 5H_2O$ and 52 g/l of $H_2SO_4$) kept at 30°±2° C. at a current of 2.0 A/dm$^2$ for 98 minutes.

After plating, it was roasted at 800° C. for five minutes in the atmosphere, and then reduced in an $H_2$ gas atmosphere at 950° C. for 20 minutes. We observed the plating thus formed. The results of observation are shown at No. 28 in Table 4.

EXAMPLE 7

The same unwoven carbon fabric was plated with Ag under the same conditions as in Example 6.

The Ag plating was formed in a bath containing 6 g/liter of AgCN and 110 g/liter of KCN kept at 25°±2° C. at a current of 5 A/dm$^2$ for 55 minutes.

After plating, it was roasted at 800° C. for three minutes in the atmosphere, and then reduced in an $H_2$ gas atmosphere at 850° C. for 40 minutes. We observed the plating thus formed. The results of observation are shown at No. 29 in Table 4.

EXAMPLE 8

The same unwoven carbon fabric was plated with Fe under the same conditions as in Example 7.

The Fe plating was formed in a bath containing 350 g/liter of FeSO4 $(NH_4)_2SO_4 \cdot 6H_2O$ and 120 g/liter of $(NH_4)_2SO_4$ bath kept at 60° C.±2° C. at a current of 8 A/dm$^2$ for 35 minutes.

After plating, it was roasted at 800° C. for three minutes in the atmosphere, and then reduced in an $H_2$ gas atmosphere at 850° C. for 40 minutes. We observed the plating thus formed. The results of observation are shown at No. 30 in Table 4.

EXAMPLE 9

An unwoven fabric 1.3 mm thick and 50 g/m$^2$ in weight per unit area was formed from 13-μm-diameter carbon fibers 1, using an epoxy resin as a binder. The content of resin was 20 wt %.

This unwoven fabric was heated at 300° C. in the atmosphere for one hour to remove any low-temperature-volatile content in the binder. As a result, the content of binder decreased to 10.1 wt % of the entire unwoven fabric.

Then, the fabric was heated at 650° C. for one hour in $N_2$ gas. The fabric obtained was cut to a 200 mm×400 mm sheet. The sheet was immersed in a nickel plating bath shown in Table 1 and plated for 38 minutes while applying a current at rate of 9.42 A/dm$^2$.

Part of the fabric thus obtained was cut off and observed under an optical microscope to measure the thickness of plating and the extent of surface irregularity Its porosity and tensile strength were also measured. The results of measurements are shown at No. 31 in Table 4.

The hollow portions of the metal fibers communicate with each other through openings formed at the joint portions of the fibers, so that the metal layer has a uniform thickness. Such a metal layer shows increased strength and high resistance to thermal stress.

According to the method of the present invention, electrical conductivity is given to the joint portions of the carbon fibers by carbonizing the binder resin. When carbonizing, the carbon fibers and the binder resin are roughened finely. A plating layer can be formed directly on the unwoven carbon fabric thus formed by electroplating. Thus, it is possible to form a sufficiently thin layer without the possibility of inclusion of impurities and wide quality variation. The unwoven metal fabric made up of hollow metal fibers according to the present invention excels conventional metal fabrics of this type in its mechanical strength, porosity, surface area, distribution of fibers and weight.

TABLE 1

| | | *1 Electroplating | | | |
|---|---|---|---|---|---|
| No | Amount of binder after volatile removed (wt %) | Average Thickness (μm) | Gap width a at joint portions (μm) | Gap width a /diameter b of hollow portions | Roughness at surface (μm) |
| 1 | 10.1 | 7 | 12.1 | 0.93 | 1.0 |
| 2 | 5.1 | 10 | 6.5 | 0.5 | 0.5 |
| 3 | 7.3 | 9 | 9.1 | 0.7 | 0.8 |
| 4 | 12.2 | 9 | 14.3 | 1.1 | 1.2 |
| 5 | 14.8 | 5 | 17.0 | 1.3 | 1.5 |
| 6 | *215.5 | 7 | 17.9 | 1.4 | 1.8 |
| 7 | 9.0 | 3 | 13.0 | 1.0 | 0.5 |

*1 For plating, watt bath (45 g/l of boric acid, 40 g/l of nickel chloride, 330 g/l of nickel sulfide) was used, Ni plate as anode. Used at about 55° C. while agitating. Plating conditions; Current Gonstant at 9.42 A/dm$^2$, plating thickness adjusted by changing the plating time.

*2 This is a control example.

TABLE 2

| | Unwoven Carbon fabric | | Heat treatment | | Amount of binder after | Heat treatment | |
|---|---|---|---|---|---|---|---|
| | Fiber | | in atmosphere | | volatile | in $N_2$ gas | |
| No. | length (mm) | porosity (%) | Temp. (°C.) | Time (min) | removed (wt %) | Temp. (°C.) | Time (min) |
| 8 | 10 | 8 | 280 | 40 | 9.0 | 750 | 40 |
| 9 | 10 | 8 | 250 | 80 | 12.0 | 850 | 30 |
| 10 | 4 | 12 | 300 | 30 | 10.0 | 600 | 60 |
| 11 | 5 | 10 | 350 | 10 | 10.0 | 800 | 40 |
| 12 | 3 | 16 | 200 | 90 | 15.0 | 700 | 40 |
| 13 | 3.5 | 12 | 300 | 20 | 11.0 | 750 | 35 |
| 14 | 10 | 8 | 280 | 30 | 12.5 | 500 | 70 |
| 15 | 5 | 12 | 280 | 50 | 8.5 | 600 | 50 |
| 16 | 3.5 | 6 | 280 | 60 | 8.3 | 700 | 35 |
| 17 | 15 | 8 | 280 | 70 | 8.1 | 800 | 30 |
| 18 | 10 | 8 | 280 | 80 | 8.0 | 650 | 60 |
| 19 | 5 | 12 | 280 | 90 | 8.0 | 550 | 80 |
| 20 | 10 | 8 | 250 | 30 | 14.0 | 600 | 50 |

TABLE 2-continued

| No | Winding on 200 mm dia. roll | *1 Plated State Average Thickness (μm) | Surface roughness (μm) | Gap width a at joint portions (μm) | Gap width a /diameter b of hollow portions | Porosity (%) | Tensile strength (kg/mm²) |
|---|---|---|---|---|---|---|---|
| 8 | good | 7.0 | 1.0 | 10.5 | 1.50 | 90.1 | 3.7 |
| 9 | cracked *2 | 7.0 | 1.3 | 13.5 | 1.93 | 90.1 | 3.2 |
| 10 | good | 10.0 | 1.0 | 11.5 | 1.64 | 85.9 | 3.3 |
| 11 | cracked *2 | 9.0 | 1.0 | 11.5 | 1.64 | 87.3 | 3.8 |
| 12 | good | 10.0 | 1.5 | 16.5 | 2.36 | 85.0 | 5.0 |
| 13 | good | 9.5 | 1.2 | 12.5 | 1.79 | 86.6 | 4.1 |
| 14 | good | 7.0 | 1.3 | 14.0 | 2.00 | 90.1 | 3.5 |
| 15 | good | 9.0 | 0.8 | 10.0 | 1.43 | 87.3 | 4.1 |
| 16 | good | 10.0 | 0.8 | 9.8 | 1.40 | 85.0 | 4.5 |
| 17 | good | 6.0 | 0.7 | 9.6 | 1.37 | 91.5 | 3.0 |
| 18 | good | 7.0 | 0.7 | 9.5 | 1.36 | 90.1 | 4.0 |
| 19 | good | 9.0 | 0.8 | 9.5 | 1.36 | 87.3 | 4.3 |
| 20 | good | 3.0 | 0.7 | 14.0 | 2.0 | 90.0 | 3.2 |

*1 Plating bath and plating conditions are the same as in Table 1. Only plating time changed.
*2 Cracks observed at edge. Batch treated.

TABLE 3

| No | Plating Conditions *1 Current (a/dm²) | Time (min) | Roasting Conditions Temp. (°C.) | Time (min) | Reducing Conditions *2 Temp. (°C.) | Time (min) | Plated State Average Thickness (μm) | Surface Roughness (μm) | Porosity (%) | Tensile Strength (kg/mm²) |
|---|---|---|---|---|---|---|---|---|---|---|
| 21 | 9.42 | 30 | 700 | 40 | 1000 | 30 | 7 | 1.0 | 88.0 | 3.0 |
| 22 | 11.3 | 25 | 900 | 8 | 10000 | 60 | 7 | 1.0 | 88.0 | 3.0 |
| 23 | 11.3 | 18 | 1000 | 3 | 10000 | 10 | 5 | 0.9 | 91.4 | 1.1 |
| 24 | 9.42 | 38 | 900 | 100 | 900 | 60 | 9 | 1.1 | 84.6 | 2.8 |
| 25 | 12.0 | 40 | 900 | 8 | 900 | 90 | 10.0 | 1.1 | 81.0 | 3.5 |
| 26 | 8.07 | 35 | 900 | 100 | 800 | 60 | 7 | 1.1 | 88.0 | 2.5 |
| 27 | 11.3 | 32 | 900 | 12 | 800 | 1200 | 9 | 1.1 | 84.6 | 2.8 |

*1 Plating bath was the same as the one used in Table 1. Voltage varied with bath resistanse.
*2 $H_2$ gas used.

TABLE 4

| No | Metal plated | Plated State Average Thickness (μm) | Roughness at surface (μm) | Gap width a at joint portions (μm) | Gap width a /diameter b of hollow portions | Porosity (%) | Tensile Strength (kg/mm²) |
|---|---|---|---|---|---|---|---|
| 28 | Cu | 7.0 | 1.1 | 9.1 | 0.70 | 88 | 1.7 |
| 29 | Ag | 8.2 | 1.0 | 12.1 | 0.93 | 85 | 1.5 |
| 30 | Fe | 8.2 | 1.0 | 12.1 | 0.93 | 85 | 1.2 |
| 31 | Ni | 7.0 | 1.0 | 12.1 | 0.93 | 97.0 | 1.5 |

What is claimed is:

1. An unwoven metal fabric comprising an aggregate of hollow metal fibers, said metal fibers being joined together, the hollow portions of said fibers communicating with each other at joint portions between said metal fibers, said metal fibers having a roughness of 0.5–1.5 μm on inner and outer surfaces thereof.

2. An unwoven metal fabric as claimed in claim 1 wherein walls of the hollow metal fibers have an average metal thickness of 3–10 μm.

3. An unwoven metal fabric as claimed in claim 1 or 2 wherein the unwoven fabric has a porosity of 80 to 98%.

4. An unwoven metal fabric as claimed in claim 1 wherein the minimum width of the opening of said metal fibers at said joint portions is not less than 50% of the diameter of the hollow portions of said metal fibers.

5. An unwoven metal fabric as claimed in claim 1 wherein said metal fibers are formed from one selected from the group consisting of Ni, Cu, Ag and Fe.

* * * * *